US009639031B1

(12) United States Patent
Embry et al.

(10) Patent No.: US 9,639,031 B1
(45) Date of Patent: May 2, 2017

(54) CONTROLLED TRANSFER NIP FOR AN ELECTROPHOTOGRAPHIC DEVICE AND METHOD OF USING SAME

(71) Applicant: Lexmark International, Inc., Lexington, KY (US)

(72) Inventors: Kerry L. Embry, Midway, KY (US); Julie Ann Gordon Whitney, Georgetown, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/009,245

(22) Filed: Jan. 28, 2016

(51) Int. Cl.
*G03G 15/16* (2006.01)

(52) U.S. Cl.
CPC ..... *G03G 15/162* (2013.01); *G03G 15/1605* (2013.01)

(58) Field of Classification Search
CPC ..... G03G 15/1605; G03G 15/1665; G03G 15/1675; G03G 15/162
See application file for complete search history.

(56) References Cited

U.S. PATENT DOCUMENTS

| | | | | |
|---|---|---|---|---|
| 5,287,152 A * | 2/1994 | Oka | G03G 15/0216 | 361/225 |
| 5,873,017 A * | 2/1999 | Soga | G03G 15/0131 | 399/302 |
| 2012/0107023 A1* | 5/2012 | Kim | G03G 15/0131 | 399/299 |
| 2016/0154334 A1* | 6/2016 | Katagiri | G03G 15/1605 | 399/66 |

* cited by examiner

*Primary Examiner* — Sandra Brase

(57) ABSTRACT

An imaging apparatus, including a transfer roll; and first and second rolls, each first roll and second roll being disposed relative to the transfer roll, the second roll forming a transfer nip with the transfer roll and the first roll being disposed upstream relative to the second roll in a media feed direction. During a toner transfer operation, the transfer roll is coupled to a predetermined voltage and the first and second rolls are coupled to at least one voltage reference so that an electric field is generated between the transfer roll and the first roll and between the transfer roll and the second roll, the first roll being associated with an electrical characteristic such that the electric field generated between the transfer roll and the first roll is limited during the toner transfer operation relative to the electric field generated between the transfer roll and the second roll.

1 Claim, 4 Drawing Sheets

FIG. 2
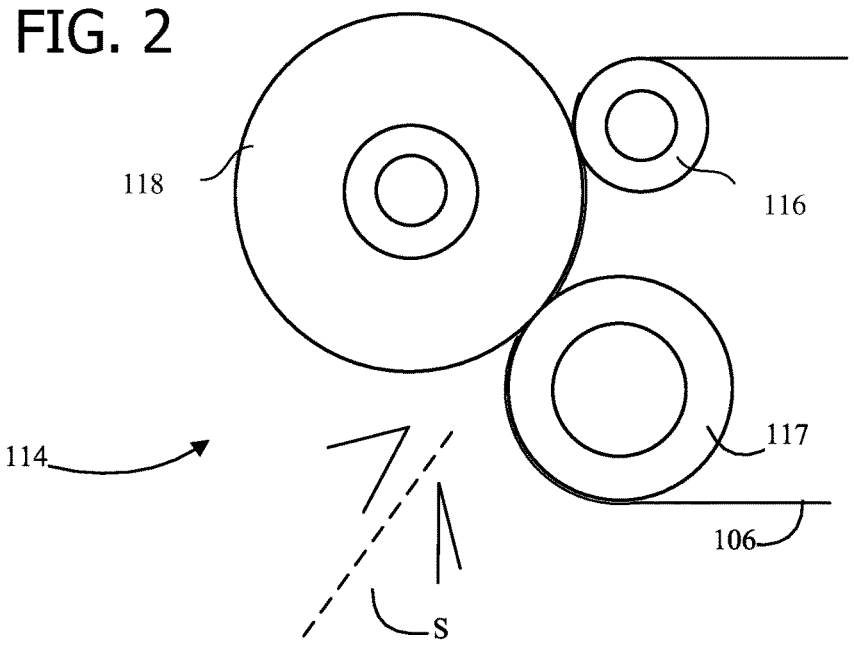
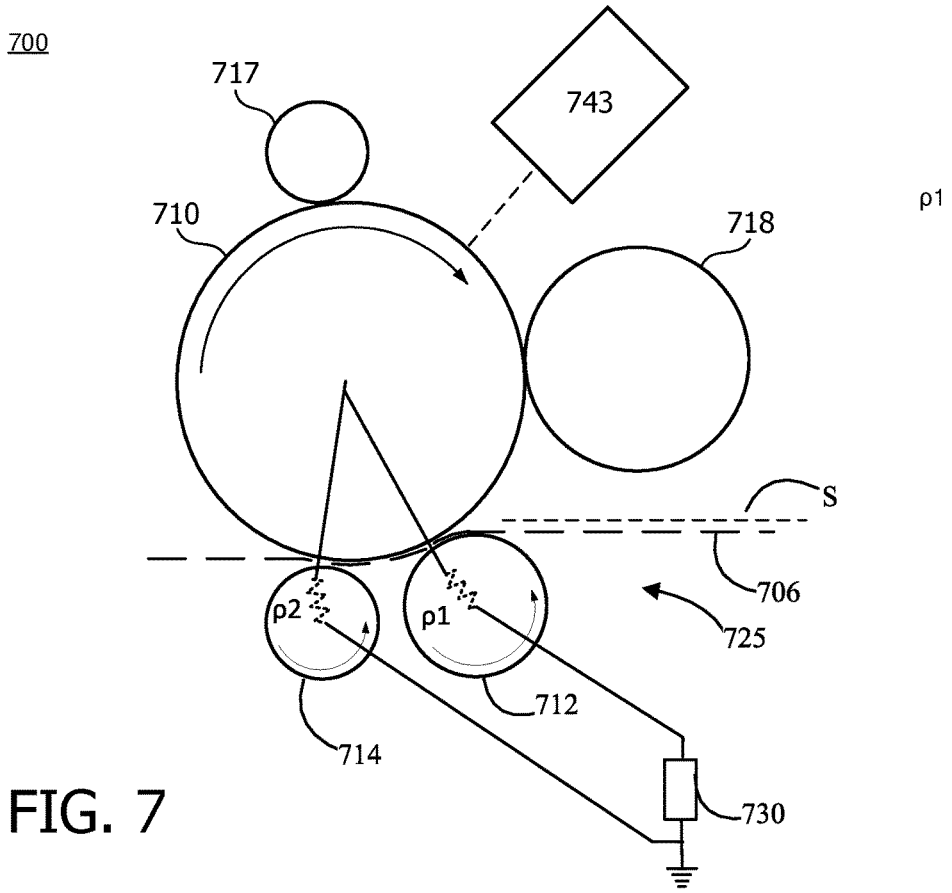
FIG. 7

CONTROLLED TRANSFER NIP FOR AN ELECTROPHOTOGRAPHIC DEVICE AND METHOD OF USING SAME

BACKGROUND

1. Field of the Disclosure

The present disclosure relates generally to an image forming apparatus and, more particularly, to a system and method for effectively controlling the shape of the electric field in the transfer nip of the image forming apparatus so as to avoid Paschen breakdown and over-transfer of toner in the transfer nip.

2. Description of the Related Art

This present disclosure concerns the transfer process for electrophotographic printers. It applies to both two step toner transfer and direct-to-paper imaging systems. Specifically it applies to the transfer process, whereby toner is moved from a donating medium, such as a transfer belt, to an accepting medium, such as a sheet of paper.

Transfer is a core process in an electrophotographic printing process. The process starts when a photosensitive roll, such as a photoconductor, is charged and then selectively discharged to create a charge image. The charge image is developed by a developer roll covered with charged toner of uniform thickness. This developed image then travels to what is referred to as "first transfer" in the case of a two-step transfer system, or the only transfer process in the case of direct-to-paper systems.

In either system, the toner enters a transfer nip area between a photoconductor roll and a transfer roll. The media to which the developed toner image is to be transferred, either a transfer belt for a two-step transfer system or a transport belt supporting paper for a direct-to-paper system, is positioned between these two rolls. Time, pressure and electric fields all influence the quality of the transfer process. A voltage is applied to the transfer roll to create a field to pull charged toner off the photoconductor onto the desired medium.

In a two-step transfer system, the transfer belt, now carrying the charged toner, travels to a second transfer nip, similar in some ways to the first transfer nip. The toner is again brought into contact with the toner receiving medium in the second transfer nip formed by a number of rolls. Typically a conductive backup roll and a resistive transfer roll together form the two primary sides of the second transfer nip. As with the first transfer, time, pressure and applied fields play significant roles in ensuring high efficiency transfer.

Some existing imaging systems utilize a three-roll configuration for the second transfer nip. Specifically, a transfer roll is disposed along the outer surface of the transfer belt and two rolls are disposed along the inner surface of the transfer belt, with each of the two rolls serving to form the transfer nip with the transfer roll. A description of a three-roll transfer nip is found in U.S. Pat. No. 8,588,667, assigned to the assignee of the present patent application, which is incorporated by reference herein in its entirety.

A three-roll second transfer nip may be wide enough to allow sufficient dwell time for transferring toner using reasonable transfer voltages and roll resistivities. However, the dwell time allows the exit nip region of the second transfer nip to continue to build an electric field until the field reaches the point of Paschen breakdown in the media and/or over-transfer of toner occurs. The result is a loss of operating space for second transfer in some environments, such as class-B environments.

Based upon the foregoing, there is a need for an improved transfer nip in an electrophotographic imaging system.

SUMMARY

Example embodiments of the present disclosure overcome shortcomings seen in prior transfer nip designs and thereby satisfy a significant need for an electrophotographic imaging system having a transfer nip whose electric fields can be quickly and easily controlled so as to avoid Paschen breakdown and over-transfer of toner. In one embodiment, the transfer nip includes an intermediate transfer member (ITM) belt forming an endless loop having an inner surface and an outer surface; a transfer roll disposed along the outer surface of the ITM belt; and first and second rolls, with each first roll and second roll being disposed within the ITM belt relative to the transfer roll, the second roll forming a transfer nip with the transfer roll, and the first roll being disposed upstream relative to the second roll in a media feed direction. During a toner transfer operation, the transfer roll is coupled to a predetermined voltage and the first and second rolls are coupled to at least one voltage reference so that an electric field is generated between the transfer roll and the first roll and between the transfer roll and the second roll. The first roll is associated with an electrical characteristic such that the electric field generated between the transfer roll and the first roll is limited during the toner transfer operation relative to the electric field generated between the transfer roll and the second roll. In an example embodiment, the first roll, second roll and the transfer roll form a transfer nip such that during the toner transfer operation, a majority of toner transfers from the ITM belt in the exit nip region by the electric field formed by the transfer roll and the second roll, at least partly due to the electrical characteristic associated with the first roll.

In a first embodiment, a shunt resistor is disposed between the first roll and the at least one voltage reference, wherein the electrical characteristic associated with the first roll is a resistance of the shunt resistor. In a second embodiment, one or more diodes are connected in series between the first roll and the at least one voltage reference, wherein the electrical characteristic associated with the first roll is a voltage across the one or more diodes. In a third embodiment, the electrical characteristic associated with the first roll is a resistivity of the first roll, the first roll having a first resistivity that is greater than a resistivity of the second roll.

BRIEF DESCRIPTION OF THE DRAWINGS

The above-mentioned and other features and advantages of the various embodiments, and the manner of attaining them, will become more apparent will be better understood by reference to the accompanying drawings, wherein:

FIG. 2 is a diagram illustrating the second transfer nip of FIG. 1 according to example embodiments;

FIG. 7 is a diagram illustrating a first transfer nip configuration for an imaging system according to another example embodiment.

DETAILED DESCRIPTION

Figure 1:
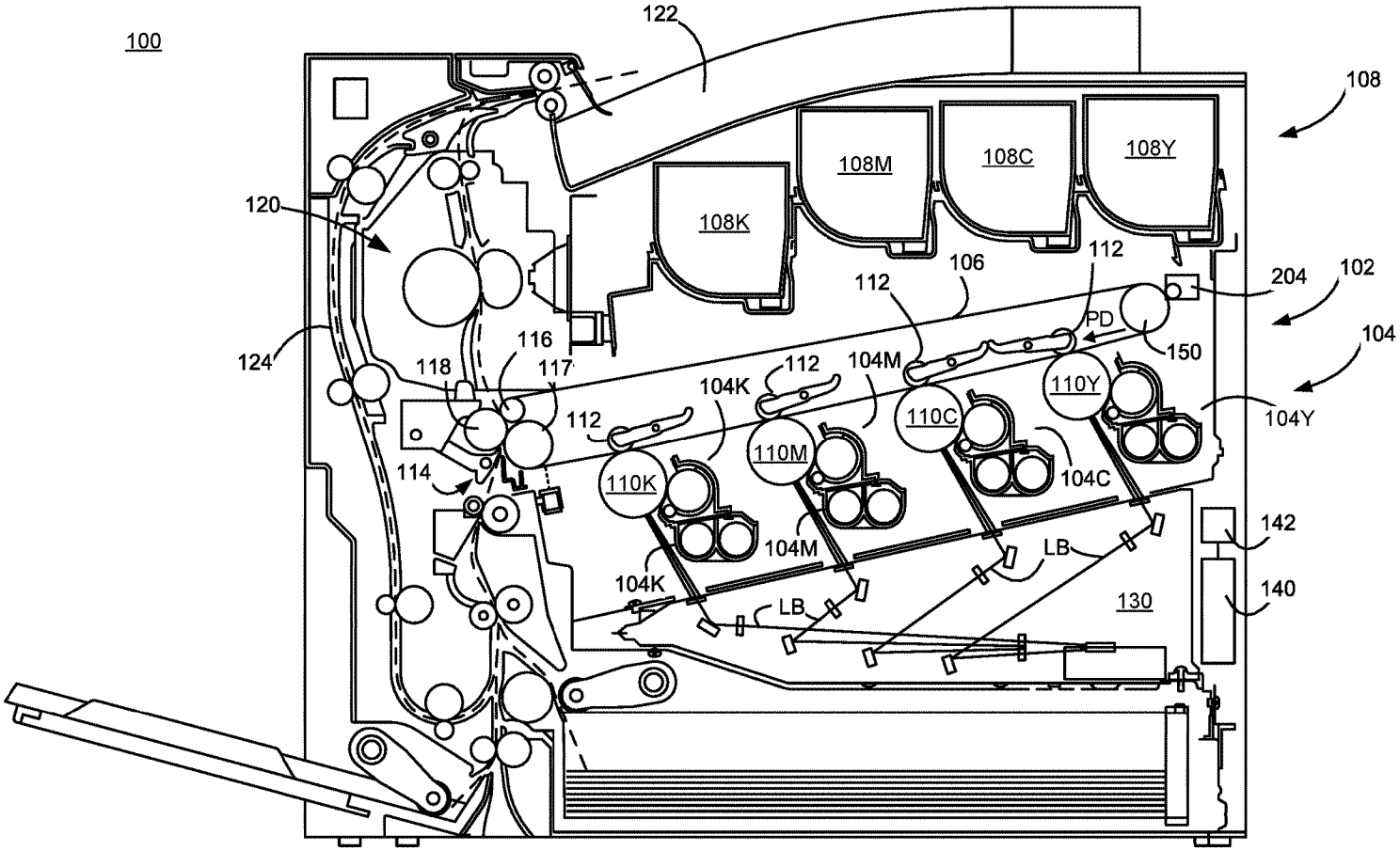
FIG. 1 is side view of a two-step electrophotographic imaging system utilizing features of example embodiments of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and positionings. In addition, the terms "connected" and "coupled" and variations thereof are not restricted to physical or mechanical connections or couplings.

Spatially relative terms such as "top", "bottom", "front", "back" and "side", and the like, are used for ease of description to explain the positioning of one element relative to a second element. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color imaging device 100 according to an example embodiment. Imaging device 100 includes a first toner transfer area 102 having four developer units 104Y, 104C, 104M and 104K that substantially extend from one end of imaging device 100 to an opposed end thereof. Developer units 104 are disposed along an intermediate transfer member (ITM) belt 106. Each developer unit 104 holds a different color toner. The developer units 104 may be aligned in order relative to a process direction PD of ITM belt 106 indicated by the arrow in FIG. 1, with the yellow developer unit 104Y being the most upstream, followed by cyan developer unit 104C, magenta developer unit 104M, and black developer unit 104K being the most downstream along ITM belt 106.

Each developer unit 104 is operably connected to a toner reservoir 108 for receiving toner for use in a printing operation. Each toner reservoir 108Y, 108C, 108M and 108K is controlled to supply toner as needed to its corresponding developer unit 104. Each developer unit 104 is associated with a photoconductive member 110*y*, 110C, 110M and 110K that receives toner therefrom during toner development to form a toned image thereon. Each photoconductive member 110 is paired with a transfer member 112 for use in transferring toner to ITM belt 106 at first transfer area 102.

During color image formation, the surface of each photoconductive member 110 is charged to a specified voltage, such as −800 volts, for example. At least one laser beam LB from a printhead or laser scanning unit (LSU) 130 is directed to the surface of each photoconductive member 110 and discharges those areas it contacts to form a latent image thereon. In one embodiment, areas on the photoconductive member 110 illuminated by the laser beam LB are discharged to approximately −100 volts. The developer unit 104 then transfers toner to photoconductive member 110 to form a toner image thereon. The toner is attracted to the areas of the surface of photoconductive member 110 that are discharged by the laser beam LB from LSU 130.

ITM belt 106 is disposed adjacent to each of developer unit 104. In this embodiment, ITM belt 106 is formed as an endless belt disposed about a backup roll 116, a drive roll 117 and a tension roll 150. Drive roll 117 is driven by a motor (not shown) to cause ITM belt 106 to move. During image forming or imaging operations, ITM belt 106 moves past photoconductive members 110 in process direction PD as viewed in FIG. 1. One or more of photoconductive members 110 applies its toner image in its respective color to ITM belt 106. For mono-color images, a toner image is applied from a single photoconductive member 110K. For multi-color images, toner images are applied from two or more photoconductive members 110. In one embodiment, a positive voltage formed in part by transfer member 112 attracts the toner image from the associated photoconductive member 110 to the surface of moving ITM belt 106.

ITM belt 106 rotates and collects the one or more toner images from the one or more developer units 104 and then conveys the one or more toner images to a media sheet at a second transfer area 114. Second transfer area 114 includes a second transfer nip formed between back-up roll 116, drive roll 117 and a second transfer roll 118. FIG. 2 illustrates second transfer area 114 formed by backup roll 116, drive roll 117 and second transfer roll 118. Tension roll 150 (FIG. 1) is disposed at an opposite end of ITM belt 106 and provides suitable tension thereto.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

Imaging device 100 may be part of a multi-function product having, among other things, an image scanner for scanning printed sheets.

Imaging device 100 further includes a controller 140 and memory 142 communicatively coupled thereto. Though not shown in FIG. 1, controller 140 may be coupled to components and modules in imaging device 100 for controlling same. For instance, controller 140 may be coupled to toner reservoirs 108, developer units 104, photoconductive members 110, fuser assembly 120 and/or LSU 130 as well as to motors (not shown) for imparting motion thereto. It is understood that controller 140 may be implemented as any number of controllers and/or processors for suitably controlling imaging device 100 to perform, among other functions, printing operations.

As mentioned above, the shape of the electric field in a toner transfer area plays a role in determining the ability to transfer toner during a printing operation. Example embodiments of the present disclosure are generally directed to a control mechanism for shaping the electric field in the toner transfer area that is independent of mechanical geometries. In this way, the example embodiments allow for a simple, flexible, fast and cost effective approach to tuning (or fine tuning) the shape of the electric field.

Figure 3:
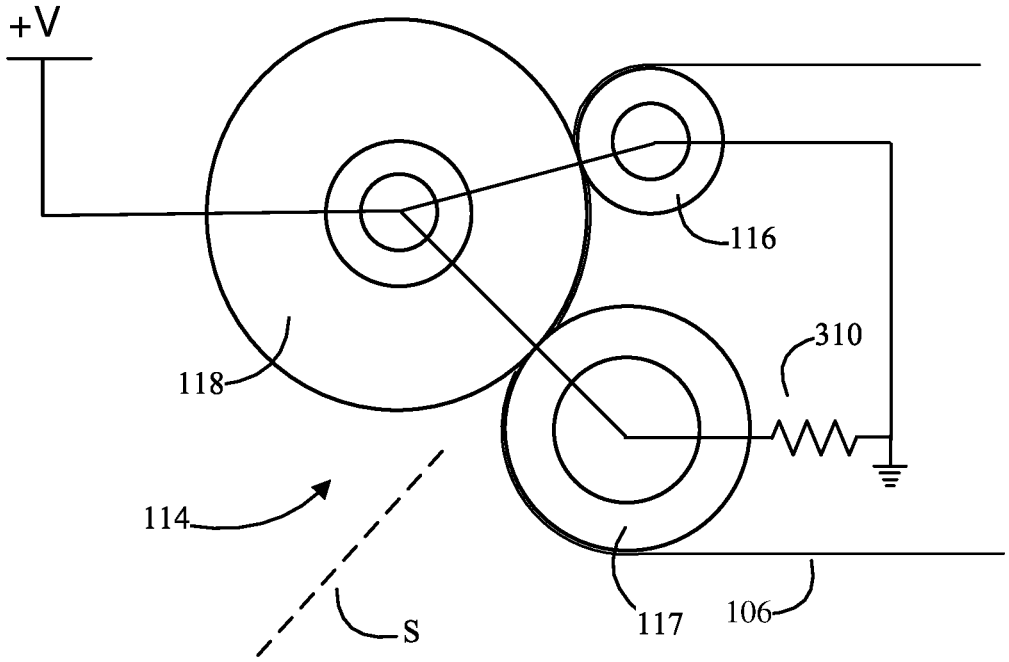
FIG. 3 is a diagram illustrating an electrical schematic of the second transfer nip of FIG. 2 according to an example embodiment.

FIG. 3 illustrates the control mechanism according to an example embodiment. As described above, backup roll 116, drive roll 117 and transfer roll 118 are disposed relative to each other and to ITM belt 106 so as to form a transfer nip between transfer roll 118 and backup roll 116 and between transfer roll 118 and drive roll 117. FIG. 3 shows a circuit implementation of second transfer area 114 during a printing (toner transfer) operation. During a printing operation, transfer roll 118 is coupled to a positive voltage level +V and each of backup roll 116 and drive roll 117 is coupled to a voltage reference. In the example embodiment, the voltage reference is ground. When positive voltage level +V and the ground reference are applied, electric fields appear in the transfer nip, i.e., between transfer roll 118 and backup roll 116 and between transfer roll 118 and drive roll 117. According to the example embodiment of FIG. 3, the control mechanism includes shunt resistor 310 disposed in the electrical path of drive roll 117, particularly between drive roll 117 and the ground reference. The amount of resistance of shunt resistor 310 is such that a voltage is created across shunt resistor 310 which causes the electric field associated with transfer roll 118 and drive roll 117 to be reduced and/or limited. The limited electric field in the early or entry nip region of the second transfer nip is such that toner transfer does not occur. Specifically, the electric field in the early nip region begins to build toward a level to cause toner to transfer from ITM belt 106 to media sheet S, but is limited by the voltage developed across shunt resistor 310 to largely prevent the transfer of toner. This allows the electric field associated with transfer roll 118 and backup roll 116 to cause toner transfer to mostly occur in the exit nip region of the second transfer nip. In the embodiment of FIG. 3, shunt resistor 310 is between about $1\times10^6$ Ohm and about $20\times10^6$ Ohm, such as about $10\times10^6$ Ohm. In another embodiment, shunt resistor 310 is between about $1\times10^6$ Ohm and about $40\times10^6$ Ohm With toner transfer occurring mostly in the exit nip region, Paschen breakdown in the media sheet S and over-transfer of toner are avoided.

Figure 4:
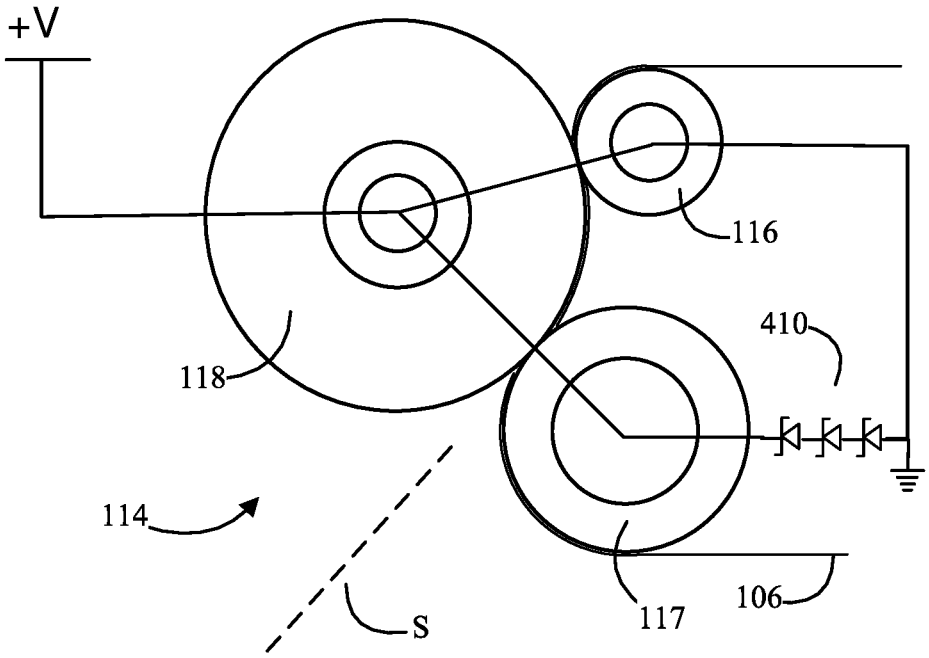
FIG. 4 is a diagram illustrating an electrical schematic of the second transfer nip of FIG. 2 according to another example embodiment.

FIG. 4 illustrates second transfer area 114 with the electric field-shaping control mechanism according to another example embodiment. In this embodiment, a plurality of series connected diodes 410 are coupled in the electrical path of drive roll 117, in this case between drive roll 117 and the ground reference. The presence of diodes 410 in the electrical path of drive roll 117 changes the voltage potential in the early nip region of the second transfer nip during toner transfer. Specifically, the change in voltage potential is a decrease thereof. The change in voltage potential may be between about 400 v and about 700 v, such as about 480 v. In one implementation, diodes 410 are Zener diodes. By reducing the voltage potential in the early nip region of the second transfer nip, the electric field generated between transfer roll 118 and drive roll 117 in the early nip region is reduced, thereby largely preventing toner transfer in the early nip region so that transfer of toner from ITM belt 106 occurs mostly in the exit nip region associated with transfer roll 118 and backup roll 116. With toner transfer occurring mostly in the exit nip region of the second transfer nip, Paschen breakdown in the media sheet S and over-transfer of toner are avoided.

Figure 5:
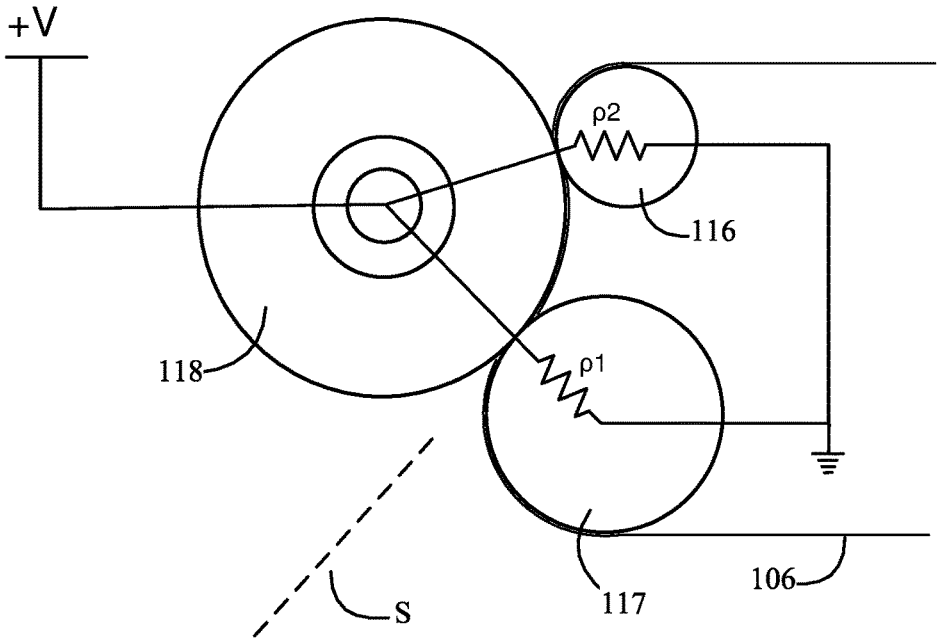
FIG. 5 is a diagram illustrating an electrical schematic of the second transfer nip of FIG. 2 according to yet another example embodiment.

FIG. 5 illustrates second transfer area 114 with the electric field-shaping control mechanism according to another example embodiment. Specifically, transfer roll 118, backup roll 116, drive roll 117 and ITM belt 106 are arranged relative to each other as described above. In addition, backup roll 116 and drive roll 117 have different electrical resistivities, with backup roll 116 having a much lower resistivity $\rho 2$ than the resistivity $\rho 1$ of drive roll 117. In one example embodiment, the resistivity $\rho 2$ of backup roll 116 is between about $1\times10^6$ (ohm-cm) and about $1\times10^8$ (ohm-cm), and the resistivity $\rho 1$ of drive roll 117 is between about $1\times10^9$ (ohm-cm) and about $1\times10^{11}$ (ohm-cm). It is understood that the resistivities of backup roll 116 and drive roll 117 may have different values and/or have a different ratio relative to each other. With backup roll 116 and drive roll 117 having different resistivities as described, the voltage potential in the early nip region is noticeably lower than the voltage potential in the exit nip region of the second transfer nip such that the electric field in the early nip region does not result in appreciable transfer of toner from ITM belt 106 to media sheet S during printing. The electric field in the exit nip region is sufficiently greater such that toner transfer occurs in the exit nip region from ITM belt 106 to media sheet S during printing. With toner transfer occurring mostly in the exit nip region of the second transfer nip, the electric field in the exit nip region does not reach the point of Paschen breakdown and/or over-transfer of toner during printing.

Second transfer area 114 having any of the above-described electric field shaping-control mechanisms allows for the electric fields in second transfer area 114 to be easily shaped and/or tuned independent of mechanical geometries of the components of second transfer area 114. For example, replacing shunt resistor 310 with another shunt resistor in second transfer area 114 of FIG. 3; adding to, subtracting from, or exchanging diodes 410 in the embodiment of FIG. 4; and exchanging backup roll 116 and/or drive roll 117 with rolls having differing resistivities can be quickly and easily performed in order to change the shape of the electric field in second transfer area 114. In addition, the costs associated with shaping the electric field in the above-described manner are relatively inexpensive. Further, implementing second transfer area 114 as described above needs no more than a single power supply to effectuate toner transfer.

Figure 6:
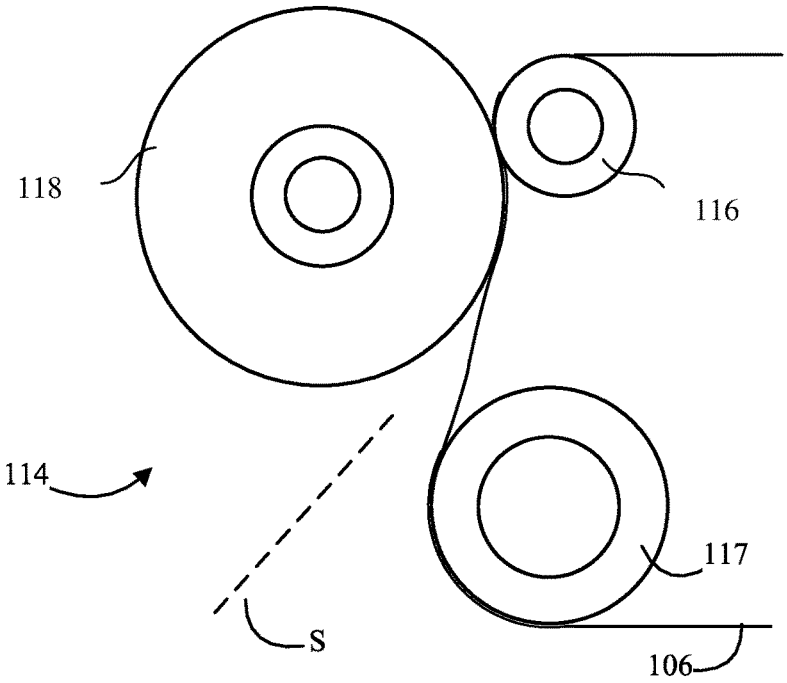
FIG. 6 is a diagram illustrating a two-roll second transfer nip for an imaging system according to another example embodiment.

As described above, the mechanisms for shaping the electric field in a transfer nip find application in relatively wide transfer nips formed by three rolls—backup roll 116, drive roll 117 and transfer roll 118. In addition to usage in three-nip transfer rolls, the above-described mechanism may be used in a two-roll transfer nip configuration having a pre-nip conditioner roll. Such a configuration is depicted in FIG. 6 in which backup roll 116 and transfer roll 118 are disposed against each other (via ITM belt 106) so as to form the transfer nip, with drive roll 117 spaced from transfer roll 118. The presence of drive roll 117 may serve to control a gap between ITM belt 106 and the incoming sheet of media S, for tailoring the electric field of the second transfer nip for enhanced toner transfer in diverse environments of temperature and humidity so as to serve to precondition the shape of the electric field just upstream of the second transfer nip. In this configuration, drive roll 117 is coupled to a reference voltage during printing. In one embodiment, drive roll 117 of FIG. 6 is part of an electrical path that includes a shunt resistor coupled between drive roll 117 and the voltage reference, similar to the use of shunt resistor 310 in FIG. 3. In a second embodiment, the electrical path instead includes cascaded diodes, such as Zener diodes, series connected between drive roll 117 and the voltage reference in FIG. 6, similar to the use of diodes 410 in FIG. 4. In a third embodiment, drive roll has a resistivity that is greater than the resistivity of backup roll 116, as described above with respect to the embodiment of FIG. 5.

As described above, the mechanisms for shaping the electric field in a transfer nip find application in a second transfer area of an imaging apparatus. In addition to usage in second transfer areas, the above-described mechanism may be used in first transfer areas, whether it be part of a two-step toner transfer system or a single-step toner transfer system. A first transfer configuration is depicted in FIG. 7, which illustrates portions of an imaging apparatus 700 in which a toner image is transferred from a photoconductive member or roll 710 to either a sheet of media S or to an ITM belt. Imaging apparatus 700 includes charge member 717, developer roll 718, and photoconductive member 710. Charge member 717 charges the surface of photoconductive member 710 to a specified positive voltage. A laser beam from laser scan unit 743 contacts the surface of a photoconductive member 710 and discharges those areas it contacts to form a latent image. Developer roll 718 serves to develop toner into the latent image on photoconductive member 710. The toner particles are attracted to areas of the surface of photoconductive member 710 discharged by the laser.

Photoconductive member 710 is positioned opposite rolls 712 and 714, both of which form a transfer area 725 with photoconductive member 710. A belt 706 may be disposed between photoconductive member 710 and rolls 712 and 714. If imaging apparatus 700 is a two-step toner transfer system, belt 706 is an ITM belt onto which a toner image from photoconductive member 710 is transferred in transfer nip 725. On the other hand, if imaging apparatus 700 is a single-step or direct transfer system in which toner is transferred directly from photoconductive member 710 onto a media sheet S, then belt 706 is a transport belt for transporting media sheet S along the media path of imaging apparatus 700. It is understood that if imaging apparatus 700 is a monochrome imaging system, belt 706 may not be necessary.

During a toner transfer operation, rolls 712 and 714 are coupled to at least one voltage reference so as to cause charged toner particles to transfer from photoconductive member 710 to either ITM belt 706 or media sheet S. In addition, a component 730 may be disposed in the electrical path of roll 712, between roll 712 and the voltage reference. In one embodiment, component 730 is a shunt resistor, like shunt resistor 310 in FIG. 3. In a second embodiment, component 730 is a set of series-connected diodes, such as Zener diodes, similar to Zener diodes 410 of FIG. 4. In an alternative third embodiment, component 730 is not used and instead the resistivity $\rho 1$ of roll 712 is greater than the resistivity $\rho 2$ of roll 714, similar to the resistivities described above with respect to the embodiment of FIG. 5. The result of the shunt resistor, Zener diodes and roll resistivities is that the electric field formed by photoconductive member 710 and roll 712 is limited such that most of the toner transfers in the electric field formed by photoconductive member 710 and roll 714. Accordingly, Paschen breakdown and/or over-transfer of toner do not occur.

Still further, it is understood that in yet another example embodiment, roll 712 does not form part of the transfer nip of imaging apparatus 700 and instead serves as a preconditioning roll, as described above with respect to roll 117 of FIG. 6. Similar to roll 117 of FIG. 6, roll 712 of FIG. 7 may be associated with a shunt resistor or a set of series connected Zener diodes, or have a resistivity that is noticeably larger than the resistivity of roll 714.

The foregoing description of several methods and embodiments of the present disclosure have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An electrophotographic imaging apparatus, comprising:

a voltage source;

electrical ground;

a shunt resistor having a relatively large resistance of at least 1 megohm;

an intermediate transfer member (ITM) belt forming an endless loop having an inner surface and an outer surface, the ITM belt for receiving and transferring an image of toner;

a transfer roll disposed along the outer surface of the ITM belt; and a drive roll and a backup roll, each of the drive roll and the backup roll being disposed along the inner surface of the ITM belt opposite to the transfer roll, the backup roll forming a transfer nip with the transfer roll and the drive roll being disposed upstream relative to the backup roll in a media feed direction, wherein the transfer roll is coupled to the voltage source having a predetermined voltage and each of the drive roll and the backup roll is coupled to said electrical ground, the drive roll being connected to said electrical ground via the shunt resistor thereby having a higher voltage potential closer to the predetermined voltage during use in comparison to the backup roll having a lower voltage potential closer to electrical ground such that a majority of toner of the image moves from the ITM belt toward the transfer roll nearer the backup roll than the drive roll.

* * * * *